US005669337A

United States Patent [19]

Drouillard

[11] Patent Number: 5,669,337

[45] Date of Patent: Sep. 23, 1997

[54] TEMPERATURE SENSING SYSTEM FOR AN INTERNAL COMBUSTION ENGINE

[75] Inventor: Darrell C. Drouillard, Windsor, Canada

[73] Assignee: Ford Global Technologies, Inc., Dearborn, Mich.

[21] Appl. No.: 643,700

[22] Filed: May 6, 1996

[51] Int. Cl.[6] ..... F01P 5/14

[52] U.S. Cl. ..... 123/41.15; 340/449; 374/145

[58] Field of Search ..... 123/41.15; 165/11.1; 374/144, 145; 340/439, 449, 450; 73/117.3

[56] References Cited

U.S. PATENT DOCUMENTS

| | | | |
|---|---|---|---|
| 3,356,807 | 12/1967 | Brown et al. | 340/449 |
| 3,838,668 | 10/1974 | Hays et al. | 123/41.2 |
| 3,886,912 | 6/1975 | Haglund . | |
| 3,963,010 | 6/1976 | Harned | 123/122 AC |
| 4,013,047 | 3/1977 | Harned . | |
| 4,493,292 | 1/1985 | Showalter | 123/41.2 |
| 5,201,840 | 4/1993 | Sausner et al. | 123/41.15 |
| 5,494,005 | 2/1996 | Saur | 123/41.1 |

FOREIGN PATENT DOCUMENTS

| | | | |
|---|---|---|---|
| 61-83446 | 9/1986 | Japan | 123/41.15 |
| 3-145518 | 6/1991 | Japan . | |

*Primary Examiner*—Noah P. Kamen
*Attorney, Agent, or Firm*—Neil P. Ferraro

[57] ABSTRACT

A temperature sensing system for an internal combustion engine includes a heat transfer element communicating with both the engine coolant passage in the cylinder head and the cylinder head itself. A temperature sensor is used to sense the temperature of the heat transfer element. During normal engine operating conditions, the system records engine coolant temperature. During a loss of coolant, the system records cylinder head temperature.

12 Claims, 2 Drawing Sheets

TEMPERATURE SENSING SYSTEM FOR AN INTERNAL COMBUSTION ENGINE

FIELD OF THE INVENTION

The present invention relates generally to a temperature sensing system for sensing temperature in an internal combustion engine, and, more particularly, to a heat transfer element for transferring heat from both the engine coolant and the cylinder head of the engine to a temperature sensor.

BACKGROUND OF THE INVENTION

It is well known that malfunctions of engine cooling systems, such as a leak, will generally cause damage to the engine due to excessive engine overheating. To indicate such an event, a temperature sensing system for an internal combustion engine includes a sensor communicating with a coolant passage in the cylinder head. The temperature sensor records the bulk temperature of the coolant and relays the information to an electronic engine controller, which, in turn, relays the information to an operator. During an engine cooling system failure, the temperature sensor records a decrease in temperature because the temperature sensor now communicates with air occupying the coolant passage. Because the temperature sensor is set to indicate a fault when the coolant temperature exceeds a threshold value, no such fault is indicated.

To overcome this drawback, a temperature sensing system utilizing two temperature sensors has been employed. Typically an engine coolant temperature sensor communicates with the coolant passage and a cylinder head temperature sensor communicates with the cylinder head at a location adjacent the combustion chamber of the engine. Thus, during normal engine operating conditions, the engine coolant temperature sensor records the engine coolant temperature (ECT) and the cylinder head temperature sensor records the cylinder head temperature (CHT). Should a cooling system failure occur, CHT would increase and thus be recorded by the cylinder head temperature sensor.

The inventor of the present invention has recognized disadvantages with these systems. For example, in the two-sensor system, in addition to being a more costly system, packaging issues arise. That is, because the cylinder head temperature sensor is typically located deep within the engine, a control line must be routed through the engine to the engine controller. Also, should the cylinder head temperature sensor fail, complete disassembly of the engine may be required. Another drawback with the two-sensor system is that the algorithm programmed into the engine controller is more complex because of the need to receive information from two sensors.

Further, prior art systems do not adequately protect the integrity of the engine. Typically the time between a catastrophic cooling system failure and operator corrective action takes approximately 3 minutes at 60 mph. This time lapse can be detrimental to the engine.

SUMMARY OF THE INVENTION

An object of the present invention is to provide a temperature sensing system having one temperature sensor for sensing engine coolant temperature and cylinder head temperature.

This object is achieved and disadvantages of prior art approaches overcome by providing a novel temperature sensing system for sensing coolant temperature and fire deck temperature in an internal combustion engine. The engine has a cylinder block with a piston reciprocally housed in a cylinder formed therein. A cylinder head, having a coolant passage and a fire deck, is mounted to the cylinder block so as to close the outer end of the cylinder thereby defining a combustion chamber between the cylinder head fire deck and the top of the piston. The temperature sensing system includes a heat transfer element in operative contact with the cylinder head near the fire deck and with the coolant passage and a temperature sensor for sensing the temperature of the heat transfer element.

The above object is also achieved and disadvantages of prior art approaches also overcome by providing a novel method for determining cooling capacity degradation of a cooling system in an internal combustion engine. The engine has a cylinder block with a piston reciprocally housed in a cylinder formed therein. A cylinder head, having a coolant passage and a fire deck, is mounted to the cylinder block so as to close the outer end of the cylinder thereby defining a combustion chamber between the cylinder head fire deck and the top of the piston. The method includes the steps of placing a heat transfer element in operative contact with the cylinder head near the fire deck and with the coolant passage and sensing the temperature of the heat transfer element. The method further includes the steps of comparing the sensed temperature to a stored optimum temperature and generating a signal representing the variation between the sensed temperature and the stored optimum temperature.

An advantage of the present invention is that a low cost temperature sensing systems is provided.

Another advantage of the present invention is that a single temperature sensor is used to record both engine coolant temperature and cylinder head temperature.

Still another advantage of the present invention is that an engine overheat condition may be quickly detected.

Yet another advantage of the present invention is that cooling capacity degradation may be determined.

Other objects, features and advantages of the present invention will be readily appreciated by the reader of this specification.

BRIEF DESCRIPTION OF THE DRAWINGS

The invention will now be described, by way of example, with reference to the accompanying drawings, in which.

DETAILED DESCRIPTION OF THE PREFERRED EMBODIMENT

Figure 1:
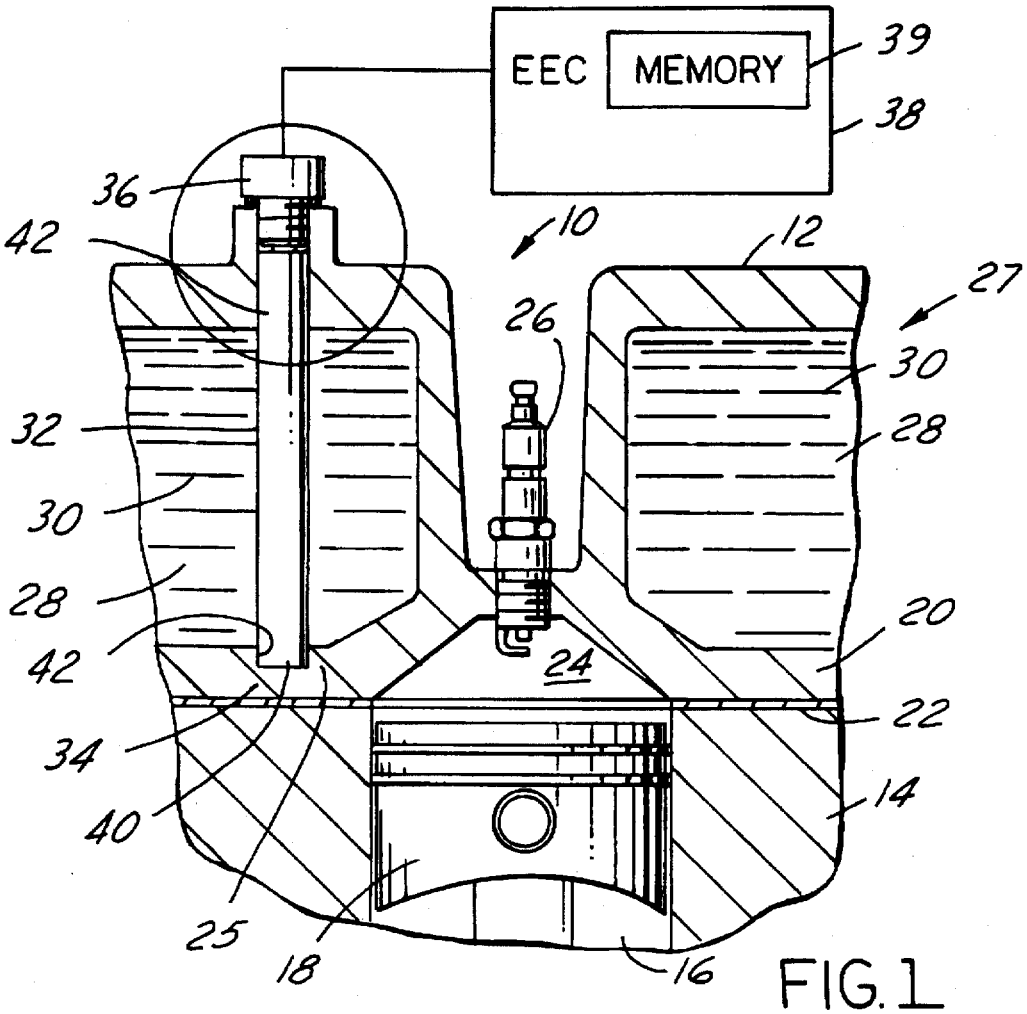
FIG. 1 is a diagrammatic partial cross-sectional view of an internal combustion engine having a temperature sensing system according to the present invention.
Figure 2:
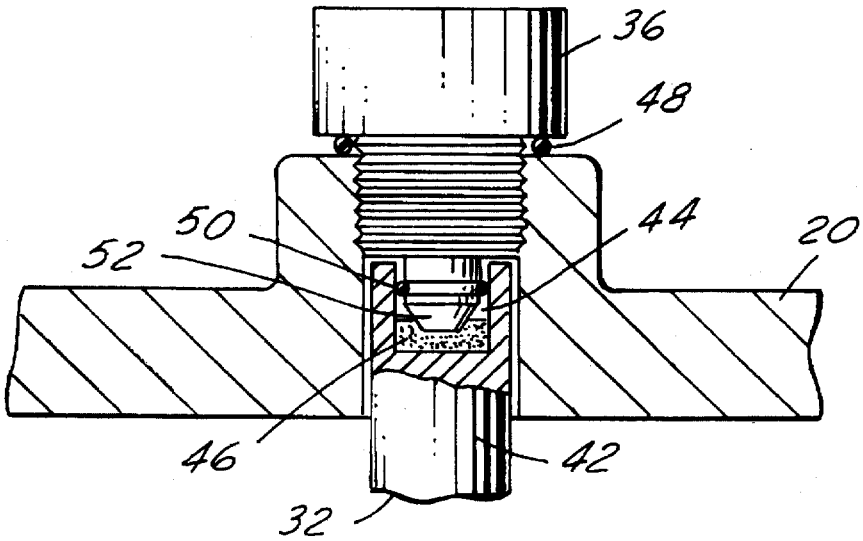
FIG. 2 is an enlarged view of a portion of the temperature sensing system encircled by line 2 of FIG. 1.

Temperature sensing system 10, shown in FIGS. 1 and 2, detects both ECT and CHT of internal combustion engine 12. Engine 12 includes cylinder block 14 having cylinder 16 formed therein and piston 18 reciprocally housed within cylinder 16. Cylinder head 20 is mounted to cylinder block 14, with cylinder head gasket 22 disposed therebetween, such that cylinder head 20 closes the outer end of cylinder 16, thereby defining combustion chamber 24 between the top of piston 18 and fire deck 25 of cylinder head 20. Sparkplug 26 is fastened to cylinder head 20 to communicate with combustion chamber 24. Cooling system 27 of engine 12 is generally provided by coolant passage 28 formed in cylinder head 20. Coolant 30 circulates in coolant passage 28 to cool engine 12.

According to the present invention, heat transfer element 32 communicates with both coolant passage 28 and fire deck 25 at location 34 in cylinder head 20 adjacent combustion chamber 24. Those skilled in the art will recognize in view of this disclosure that heat transfer element 32 may be a metallic or non-metallic thermal conductor. Preferably, heat transfer element 32 is a heat pipe. A heat pipe is a sealed metal tube with an inner lining of wick-like capillary material and a small amount of fluid in partial vacuum. Heat is absorbed near one end by vaporization of the fluid and is released near the other end by condensation of the vapor. Temperature sensor 36 senses the temperature of heat transfer element 32 and relays the information to electronic engine controller 38 having memory storage device 39. Thus, ECT can be sensed with a single sensor 36 during normal engine operating conditions because heat transfer element 32 transfers heat from coolant 30 to sensor 36. If engine coolant 30 is lost or otherwise drains from coolant passage 28, temperature sensor 36 would then record CHT at fire deck 25 because the heat at that location would be quickly transferred through heat transfer element 32. Thus, according to the present invention, temperature sensing system 10 having a single 40 sensor and a heat transfer element 32 may be used to sense both ECT during normal engine operating conditions and CHT during an engine overheat condition, such as a loss of engine coolant.

In a preferred embodiment, heat transfer element 32 is an elongate member extending through coolant passage 28 such that first end 40 engages recess 41 formed in cylinder head 20 in fire deck 25. Of course, those skilled in the art will recognize in view of this disclosure that recess 42 may be formed at a location adjacent fire deck 25, as shown in FIG. 1. Second end 42 of heat transfer element 32 contacts temperature sensor 36.

Referring in particular to FIG. 2, end 42 of heat transfer element 32 is formed with bore 44. Temperature sensor 36 is mounted within bore 44 with the use of thermally conductive paste 46. To prevent undesirable leaking of coolant 30 from passage 28, seal 48 is provided between sensor 36 and cylinder head 20. Seal 50 reduces contamination of the junction between tip 52 of sensor 36 and heat transfer element 32.

Figure 3:
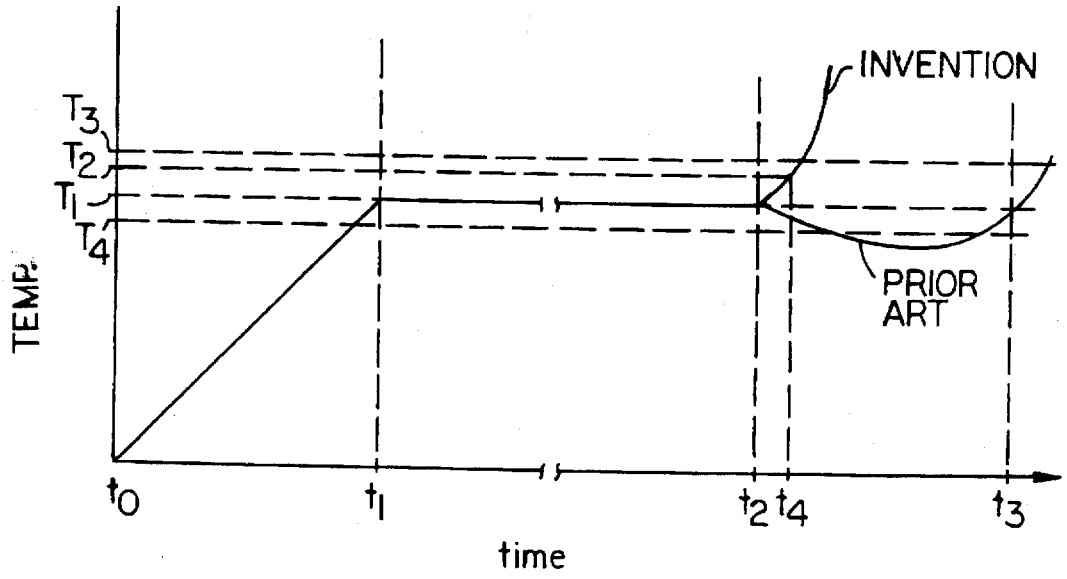
FIG. 3 is a graph of time versus temperature indicating engine temperature as recorded by the temperature sensing system according to the present invention; and, FIG. 4 is a flow chart showing a method for determining cooling system degradation according to the present invention.

FIG. 3 is a time-temperature plot showing both ECT during normal operating conditions and CHT during a loss of engine coolant. At $t_o$ when the engine is first turned on, ECT steadily increases such that at time $t_1$, when the temperature is at $T_1$, the thermostat (not shown) opens causing ECT to remain essentially constant. At time $t_2$ for example, the cooling system of engine 12 may fail. In prior systems utilizing a single sensor sensing ECT only (labeled "prior art" in FIG. 3), the temperature sensed is actually less than the previously recorded temperature $T_1$ because no medium exists in the coolant passage to conduct heat to the temperature sensor. Eventually, the temperature may rise, thereby indicating a problem at time $t_3$ when the temperature exceeds the threshold value $T_1$. As a result, a substantial time delay exists between $t_2$ and $t_3$ before an operator realizes a problem. According to the present invention, if a loss of coolant occurs at $t_2$, CHT would be recorded almost immediately because heat from fire deck 33 would be rapidly transferred through heat transfer element 32 to sensor 36. Thus, an operator would realize that a problem exists almost immediately so that the operator can take appropriate action before substantial engine damage.

Alternatively, according to the present invention, engine controller 38 may provide corrective action to reduce the likelihood of complete engine failure because of coolant loss. Controller 38 may adjust the engine operating strategy to compensate for the lost engine coolant. For example, deactivating some of the cylinders in response to the engine overheat condition may allow continued operation of engine 12 for a period of time before repairing the cooling system.

Figure 4:
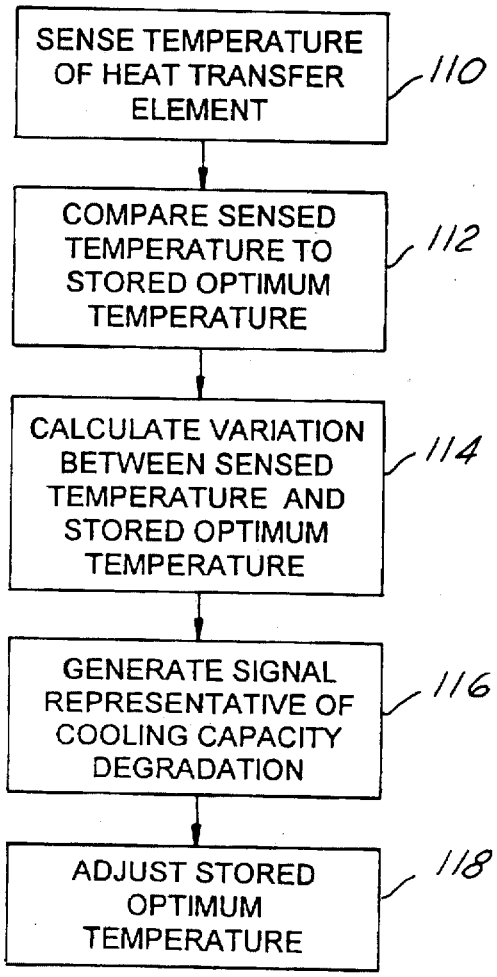

Referring now to FIG. 4, according to the present invention, cooling capacity degradation of cooling system 27 may be determined. At step 110, temperature sensor 36 senses the temperature of heat transfer element 32 and relays this information to engine controller 38. At step 112, engine controller 38 compares the sensed temperature to an optimum temperature stored in memory storage device 39. At step 114, engine controller 38 calculates the amount of cooling capacity degradation. That is, for example, referring to FIG. 3, if at time $t_4$, the sensed temperature $T_2$ has increased from an optimum temperature $T_1$, but remains within acceptable limits (between $T_3$ and $T_4$) due to, for example, a slow coolant leak, engine controller 38 calculates the variation between the sensed temperature $T_2$ and the optimum temperature $T_1$. At step 116, engine controller 38 generates a signal based the variation calculated at step 114. This signal represents the amount of cooling capacity degradation. In a preferred embodiment, as explained above, controller 38 may alter the engine operating strategy to compensate for the cooling capacity degradation. In addition, over an extended period of time, the heat transfer characteristics of heat transfer element 32 may change. This can occur, for example, due to insulating mineral deposits forming on heat transfer element 32, thereby reducing the sensitivity of temperature sensing system 10. In this case, at step 118, controller 38 may adjust the stored optimum temperature $T_1$ accordingly so as to establish a new baseline optimum temperature $T_1$.

While the best mode for carrying out the invention has been described in detail, those skilled in the art in which this invention relates will recognize various alternative designs and embodiments, including those mentioned above, in practicing the invention that has been defined by the following claims.

I claim:

1. A temperature sensing system for sensing coolant temperature and fire deck temperature in an internal combustion engine, with the engine having a cylinder block having a piston reciprocally housed in a cylinder formed therein, and a cylinder head having a coolant passage and a fire deck, with said cylinder head being mounted to the cylinder block so as to close the outer end of the cylinder thereby defining a combustion chamber between the cylinder head fire deck and the top of the piston, with said system comprising:

a heat pipe in operative contact with the cylinder head near the fire deck and with the coolant passage; and, a temperature sensor for sensing the temperature of said heat pipe.

2. A system according to claim 1 wherein said heat pipe is an elongate member, having first and second ends, extending through the coolant passage, with said first end contacting the fire deck and said second end being coupled to said temperature sensor.

3. A system according to claim 2 wherein said second end of said heat pipe comprises a bore for receiving at least a portion of said temperature sensor.

4. A system according to claim 1 wherein said sensor contacts said heat pipe.

5. A system according to claim 4 further comprising a thermally conductive paste for mounting said temperature sensor to said heat pipe.

6. An internal combustion engine comprising:

a cylinder block having a piston reciprocally housed in a cylinder formed therein;

a cylinder head having a coolant passage with coolant circulating therein and a fire deck, with said cylinder head being mounted to said cylinder block so as to close the outer end of said cylinder thereby defining a combustion chamber between said cylinder head fire deck and the top of said piston;

a heat pipe in operative contact with said cylinder head fire deck and with said coolant circulating through said coolant passage; and, a temperature sensor for sensing the temperature of said heat pipe.

7. An engine according to claim 6 wherein said heat pipe is an elongate member extending through said coolant passage and having first and second ends, with said first end contacting said fire deck and said second end being coupled to said temperature sensor.

8. An engine according to claim 7 wherein a recess is formed in said coolant passage for receiving said first end of said heat pipe.

9. An engine according to claim 7 wherein said second end of said heat pipe comprises a bore for receiving at least a portion of said temperature sensor.

10. An engine according to claim 7 further comprising a thermally conductive paste for mounting said temperature sensor to said heat pipe.

11. A method for determining cooling capacity degradation of a cooling system in an internal combustion engine, with the engine having a cylinder block having a piston reciprocally housed in a cylinder formed therein and a cylinder head having a coolant passage and a fire deck, with said cylinder head being mounted to the cylinder block so as to close the outer end of the cylinder thereby defining a combustion chamber between the cylinder head fire deck and the top of the piston, with said method comprising the steps of:

placing a heat pipe in operative contact with the cylinder head near the fire deck and with the coolant passage;

sensing the temperature of the heat pipe;

comparing the sensed temperature to a stored optimum temperature; and, generating a signal representing the variation between the sensed temperature and the stored optimum temperature.

12. A method according to claim 11 further comprising the step of adjusting the stored optimum temperature so as to establish a new optimum temperature.

* * * * *